US008708667B2

(12) United States Patent
Collingborn

(10) Patent No.: US 8,708,667 B2
(45) Date of Patent: Apr. 29, 2014

(54) FUEL PUMP ASSEMBLY

(75) Inventor: Peter Alban George Collingborn, Gillingham (GB)

(73) Assignee: Delphi International Operations Luxemboug S.A.R.L., Luxembourg (LU)

( * ) Notice: Subject to any disclaimer, the term of this patent is extended or adjusted under 35 U.S.C. 154(b) by 745 days.

(21) Appl. No.: 12/574,391

(22) Filed: Oct. 6, 2009

(65) Prior Publication Data

US 2010/0092315 A1 Apr. 15, 2010

(30) Foreign Application Priority Data

Oct. 14, 2008 (GB) ..... 0818811.2

(51) Int. Cl.

| | |
|---|---|
| ***F04B 1/04*** | (2006.01) |
| ***F04B 27/04*** | (2006.01) |
| ***F04B 1/00*** | (2006.01) |
| ***F01B 1/06*** | (2006.01) |

(52) U.S. Cl.
USPC ..... 417/273; 417/269; 417/271; 92/148

(58) Field of Classification Search
USPC ..... 417/364, 269, 273; 123/497; 92/148, 92/149, 72, 129; 91/491
See application file for complete search history.

(56) References Cited

U.S. PATENT DOCUMENTS

| | | | | | |
|---|---|---|---|---|---|
| 1,882,448 | A | * | 10/1932 | Roche | 123/51 B |
| 1,962,530 | A | * | 6/1934 | Schubert | 123/71 R |
| 1,967,596 | A | * | 7/1934 | Schubert | 123/54.2 |
| 2,059,758 | A | * | 11/1936 | Stearns | 417/454 |
| 2,088,863 | A | * | 8/1937 | McClelland | 123/72 |
| 2,697,403 | A | * | 12/1954 | Benedek | 417/439 |
| 3,123,058 | A | * | 3/1964 | Wooge | 123/54.2 |
| 5,009,580 | A | * | 4/1991 | Maru | 417/533 |
| 5,150,670 | A | * | 9/1992 | Sadler | 123/54.2 |
| 5,167,493 | A | * | 12/1992 | Kobari | 417/273 |
| 5,511,956 | A | * | 4/1996 | Hasegawa et al. | 417/271 |
| 6,048,180 | A | * | 4/2000 | Konishi et al. | 417/364 |
| 6,289,875 | B1 | * | 9/2001 | Shinohara et al. | 123/450 |

(Continued)

FOREIGN PATENT DOCUMENTS

| | | |
|---|---|---|
| DE | 41 38 313 | 5/1992 |
| DE | 103 05 011 | 8/2004 |

(Continued)

OTHER PUBLICATIONS

British Search Report dated Feb. 11, 2009.
European Search Report dated Feb. 22, 2010.

*Primary Examiner* — Charles Freay
*Assistant Examiner* — Alexander Comley
(74) *Attorney, Agent, or Firm* — Thomas N. Twomey

(57) ABSTRACT

A fuel pump assembly for a fuel injection system comprises a drive shaft, at least two pump heads each of which is axially displaced along the drive shaft, each pump head having a respective plunger for pressurising fuel within a respective pump chamber, and at least two cams provided on the drive shaft, each of which is associated with a respective one of the pump heads. Adjacent pump heads are offset angularly from one another by an amount sufficient to allow a region of overlap, in an axial direction along the drive shaft, between the adjacent pump heads.

19 Claims, 8 Drawing Sheets

(56) References Cited

U.S. PATENT DOCUMENTS

| | | | | |
|---|---|---|---|---|
| 6,302,659 | B1 * | 10/2001 | Parker et al. | 417/273 |
| 6,350,107 | B1 * | 2/2002 | Hamutcu | 417/273 |
| 7,281,519 | B2 * | 10/2007 | Schroeder et al. | 123/445 |
| 7,766,626 | B2 * | 8/2010 | Pabst et al. | 417/273 |
| 2010/0092315 | A1 * | 4/2010 | Collingborn | 417/364 |

FOREIGN PATENT DOCUMENTS

| | | | |
|---|---|---|---|
| DE | 10305011 | A1 * | 8/2004 |
| DE | 10 2004 048 714 | | 4/2006 |
| EP | 1 013 921 | | 6/2000 |
| GB | 958341 | | 5/1964 |
| WO | 91/02157 | | 2/1991 |

* cited by examiner

FUEL PUMP ASSEMBLY

TECHNICAL FIELD

The invention relates to a fuel pump assembly suitable for use in a common rail fuel injection system for supplying high pressure fuel to a compression ignition internal combustion engine. In particular, the invention relates to a fuel pump assembly having at least two pumping plungers each driven by a respective cam on an engine driven shaft.

BACKGROUND TO THE INVENTION

Common rail fuel injection systems for compression ignition (diesel) internal combustion engines provide excellent control of all aspects of engine operation and require a pump to act as a source of high pressure fuel. One known common rail fuel pump is of radial pump design and includes three pumping plungers arranged at equi-angularly spaced locations around an engine driven cam. Each plunger is mounted within a plunger bore provided in a pump head mounted to a main pump housing. As the cam is driven in use, the plungers are caused to reciprocate within their bores in a phased, cyclical manner. As the plungers reciprocate, each causes pressurisation of fuel within a pump chamber defined at one end of the associated plunger bore in the pump head. Fuel that is pressurised within the pump chambers is delivered to a common high pressure supply line and, from there, is supplied to a common rail or other accumulator volume, for delivery to the downstream injectors of the common rail fuel system.

Typically, the cam carries a cam rider which extends coaxially with the engine drive shaft and is provided with a plurality of flats, one for each of the plungers. An intermediate drive member in the form of a tappet cooperates with each flat on the cam rider and couples to a respective one of the plungers so that, as the tappet is driven upon rotation of the cam, drive is imparted to the plunger. For some applications, however, it is a disadvantage of such radial pump designs that the overall width of the pump is large. In some engines, due to the inherent inflexibility of engine layout, excessive pump width prevents such pumps being used.

Another known type of common rail fuel pump is of the "in-line" type in which two or more pumping plungers are arranged in a line, side by side, axially along the engine drive shaft. The drive shaft carries a corresponding cam for each plunger, each plunger being driven in turn by its cam as the drive shaft rotates. It is known for the plungers to be housed within plunger bores provided in a common monobloc pump head. Whilst known in-line pumps are more compact laterally than radial pump designs, they can have excessive length and do not readily fit in all engine layouts. Furthermore, as the pump heads incorporate all of the pumping chambers, high pressure drillings for carrying pressurised fuel to a pump outlet and high pressure outlet valves, the monobloc is complicated, difficult and expensive to make.

Another known concept is to provide several separate pump heads arranged side by side, in a line along the drive shaft. Manufacture of the individual pump heads is simplified compared to the common monobloc pumping head, but again the overall length of the pump can be excessive and impractical for some engine layouts.

It is an object of the present invention to provide a fuel pump assembly which avoids or overcomes the limitations of the aforementioned types of pump.

SUMMARY OF THE INVENTION

According to the present invention, there is provided a fuel pump assembly for a fuel injection system comprising a drive shaft, at least two pump heads arranged along the drive shaft, each pump head having a respective plunger for pressurising fuel with a respective pump chamber, and at least two cams provided on the drive shaft, each of which is associated with a respective one of the pump heads to effect a plunger pumping cycle as the drive shaft is driven. Adjacent pump heads are mounted so as to be offset angularly from one another by an amount sufficient to allow a region of overlap, in an axial direction along the drive shaft, between said adjacent pump heads. Suitably, each of the at least two pump heads is axially displaced along the drive shaft, so that although they may overlap in the axial direction, they do not lie in the same axial plane.

It is a benefit of the invention that the angular offsetting between the pump heads allows the heads to overlap along the axis of the drive shaft, thereby reducing the overall length of the pump.

In one embodiment a fuel pump assembly for a fuel injection system comprises a drive shaft, and at least two pump heads each of which is axially displaced along the drive shaft. Each pump head has a respective plunger for pressurising fuel within a respective pump chamber. Adjacent pump heads are axially displaced and offset angularly from one another by an amount sufficient to allow a region of overlap (R), in an axial direction along the drive shaft, between said adjacent pump heads. The region of overlap (R) is less than the maximum width of the adjacent pump heads. At least two cams are provided on the drive shaft, each of which is associated with a respective one of the pump heads. The angular offset between the respective cams is selected so as to achieve evenly spaced pumping events.

The cams associated with adjacent ones of the pump heads are offset angularly by substantially the same amount, and in the same angular direction, as the angular offset between the adjacent ones of the pump heads but with a 180° phase difference between the associated cams, so as to enable evenly spaced pumping events within the respective pump chambers. In other words, in this arrangement, the angular offset between the respective cams is 180° plus the angular offset of the respective pump heads. For example, the fuel pump assembly may include a first pump head and a second pump head, wherein the first pump head is at a pump head angular reference position, a corresponding first one of the cams is at a cam angular reference position, the second pump head is spaced angularly from the pump head angular reference position by an angular offset amount and a corresponding second one of the cams is spaced by the angular offset amount from a position substantially 180° from the cam angular reference position.

Alternatively, the cams associated with adjacent ones of the pump heads are offset angularly by a different amount from the angular offset between the adjacent ones of the pump heads, so as to enable unevenly spaced pumping events within the respective pump chambers.

Whether the cams and pump heads are offset by the same of different amounts will depend on the requirements of the pump application.

For example, the fuel pump assembly includes a first pump head and a second pump head, wherein the first pump head is at a pump head angular reference position of 0° and a corresponding first one of the cams is at an angular reference position spaced 180° from the pump head angular reference position.

In another embodiment, the fuel pump assembly may comprise at least three pump heads, wherein the direction of the angular offset between a pair of adjacent pump heads alternates between adjacent pump head pairs. Such an arrangement is particularly advantageous as it resembles that of the cylinders in a "vee" engine and, hence, provides a compact arrangement.

Alternatively, the angular offset between a pair of adjacent pump heads is substantially the same and in the same angular direction as the angular offset between the preceding adjacent pump head pair.

In yet another embodiment, the angular offset between a first pair of adjacent pump heads is different from the angular offset between a second pair of adjacent pump heads. The angular offset between the second pair of adjacent pump heads may be in the same or in the opposite direction to that of the first pair. Thus, the angular spacing of adjacent pump heads along the drive shaft can be selected to be at any convenient angle. In this way, the pump heads and associated engine components can conveniently be arranged to suit with the packing requirements of any particular engine type, thus, maintaining the benefits associated with the invention of reduced length of drive shaft and reduced packing constraints.

The cams associated with a pair of adjacent pump heads may be offset angularly by substantially the same amount, and in the same angular direction, as the angular offset between the adjacent pair of pump heads. Typically, however, the angular offset between the cams associated with adjacent ones of the pump heads is substantially the same and in the same angular direction as the angular offset between the adjacent ones of the pump heads plus 180°, so as to enable evenly spaced pumping events within the respective pump chambers.

Each of the pump heads has an associated cam follower which cooperates with the respective cam to impart drive to the plunger as the drive shaft is driven to rotate. In a pump with only two pump heads, it may be preferable to use cam riders as the cam followers, but for pumps having more than two pump heads this is not possible for assembly purposes, unless the cams are of increasing size. For pump assemblies having more than two pump heads, it may therefore be preferable to use rollers as cam followers.

In a further preferred embodiment, each of the pump heads has an associated outlet for providing fuel that is pressurised within the associated pump chamber to a fuel accumulator volume.

Typically, the pump assembly further includes a main pump housing onto which the pump heads are mounted, wherein each of the pump heads delivers fuel that is pressurised within the associated pump chamber to the main pump housing which, in turn, delivers fuel to a high pressure outlet to a downstream fuel accumulator volume.

These and other aspects, objects and the benefits of this invention will become clear and apparent on studying the details of this invention and the appended claims.

All references cited herein are incorporated by reference in their entirety. Unless otherwise defined, all technical and scientific terms used herein have the same meaning as commonly understood by one of ordinary skill in the art to which this invention belongs.

BRIEF DESCRIPTION OF THE DRAWINGS

The invention will now be described, by way of example only, by reference to the following drawings in which.

DETAILED DESCRIPTION OF PREFERRED EMBODIMENTS

Figure 1:
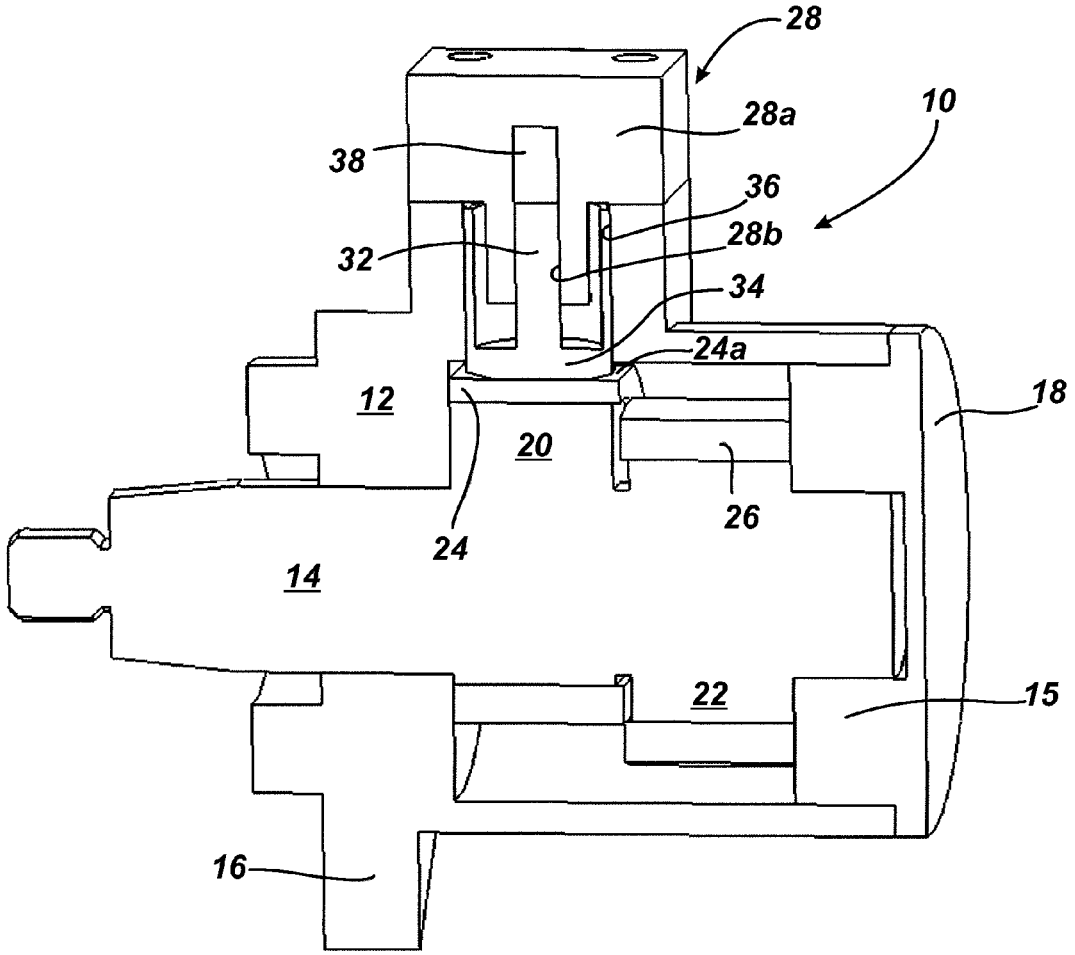
FIG. 1 is a cut-away view of the fuel pump assembly of a first embodiment of the present invention.

Referring to FIGS. 1 to 6, a fuel pump assembly 10 of a first embodiment of the present invention includes a main pump housing 12 provided with an axially extending bore through which a drive shaft 14 extends. A front end of the main pump housing 12 includes an integral front plate 16 and a rear end of the bore is closed by a rear closure plate 18 (as shown in FIG. 1). The drive shaft 14 is mounted within the main pump housing 12 on front and rear bearings (only the rear bearing 15 is shown in FIG. 1). The drive shaft 14 caries first and second cams 20, 22 which are integrally formed with the drive shaft 14. Each of the cams 20, 22 is angularly offset about the drive shaft 14 with respect to the other cam, as will be described in further detail below. Each cam 20, 22 carries a respective cam rider 24, 26 of generally tubular form which extends coaxially with the drive shaft 14. Each cam rider 24, 26 is provided with a flattened region (flat), 24*a*, 26*a* respectively.

The first cam 20 is associated with a first pump head 28 and the second cam 22 is associated with the second pump head 30. In the cut-away view shown in FIG. 1, the first pump head 28 is shown in detail to have a pump head housing 28*a* provided with a plunger bore 28*b* for receiving a pumping plunger 32. An end surface of the pumping plunger 32 is received within a pump chamber 38 defined within the pump head housing 28*a*. The second pump head 30 is not visible in the cut-away view of FIG. 1 as it is offset angularly about the drive shaft 14, relative to the first pump head 28, as discussed further below. FIGS. 2 to 6 show the relative positions of the first and second pump heads 28, 30. The second pump head 30 is identical to the first pump head 28 and so includes a pump head housing 30*a*, a respective plunger (not shown in the figures) and a respective pump chamber (not shown in the figures).

The pumping plunger 32 of the first pump head 28 is coupled with an intermediate drive member in the form of a tappet 34, the base of which cooperates with the flat 24*a* of the cam rider 24. Typically, as shown in FIG. 1, the tappet 34 is a bucket-shaped tappet of generally U shaped cross section and is received within a tappet bore 36 provided in the main pump housing 12. In a similar manner, the base of the tappet of the second pump head 30 cooperates with the flat 26*a* of the second cam rider 26.

As the drive shaft 14 is driven, in use, the cams 20, 22 are caused to rotate with the drive shaft 14 and the tappet 34 is caused to reciprocate within the tappet bore 36 in the main pump housing 12. Consequently, the plunger 32 of the first pump head 28 is caused to reciprocate within the plunger bore 28*b* causing fuel within the pump chamber 38 to be pressurised. As the tappet 34 and the plunger 32 are driven together, the plunger 32 performs a pumping cycle including a pumping stroke, during which the tappet 34 and the plunger 32 are driven radially outward from the drive shaft 14 to reduce the volume of the pump chamber 38. During this pumping stroke the pumping plunger 32 causes fuel within the pump chamber 38 to be pressurised to a high level.

During a subsequent plunger return stroke, effected by means of a return spring (not shown), the tappet 34 and the plunger 32 are urged in a radially inward direction, towards the drive shaft 14, to increase the volume of the pump chamber 38. During the return stroke of the plunger 32 and its tappet 34, the plunger 32 is urged outwardly from the plunger bore 28*b* and fuel at relatively low pressure fills the pump chamber 38, ready for the next pumping stroke. The provision of the return spring serves to urge the plunger 32 to perform its return stroke and additionally ensures contact is maintained between the tappet 34 and the flat 24*a* of the cam rider 24 at all times throughout the pumping cycle. Fuel is pressurised within the second pump head 30 in a similar manner to the first.

Figure 2:
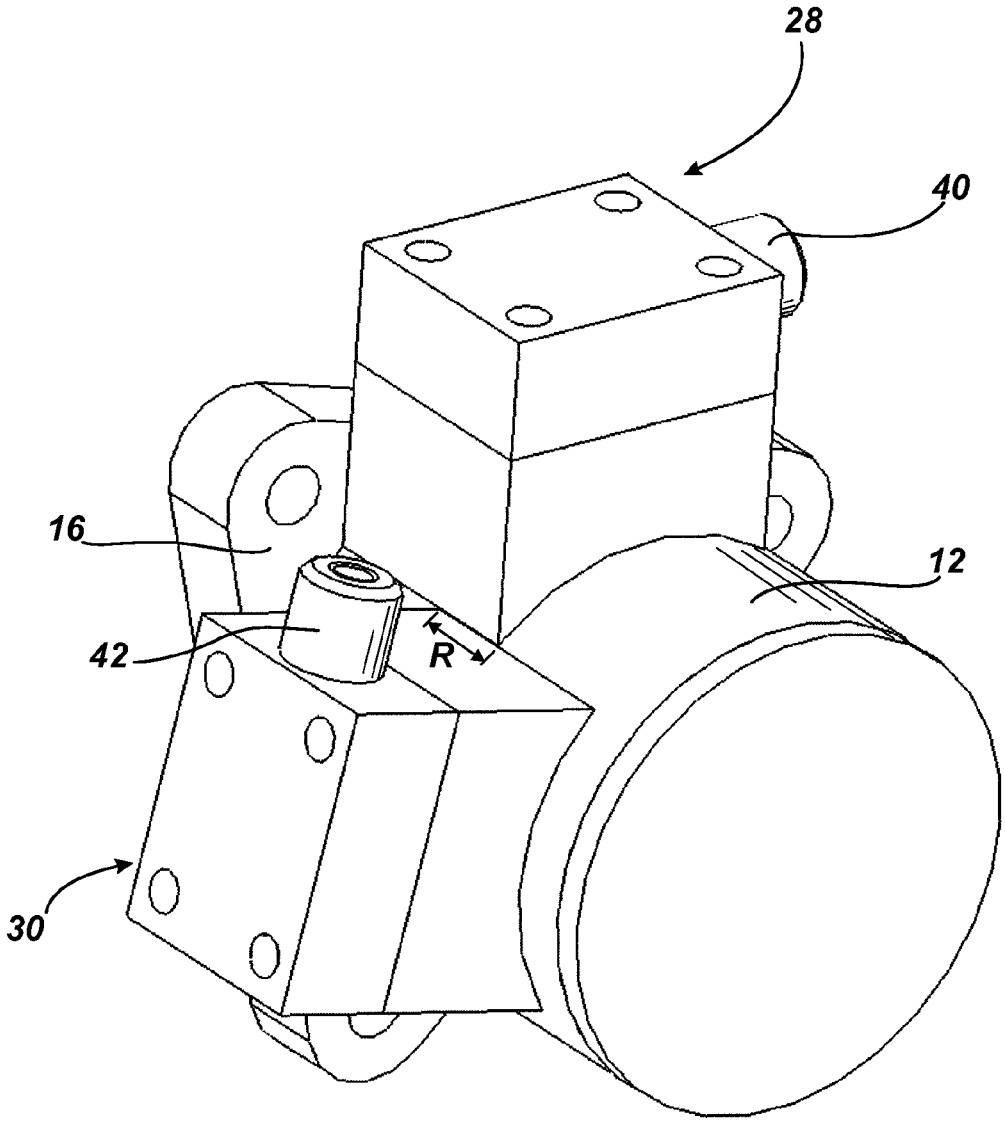
FIG. 2 is a perspective view of the fuel pump assembly in FIG. 1.
Figure 3:
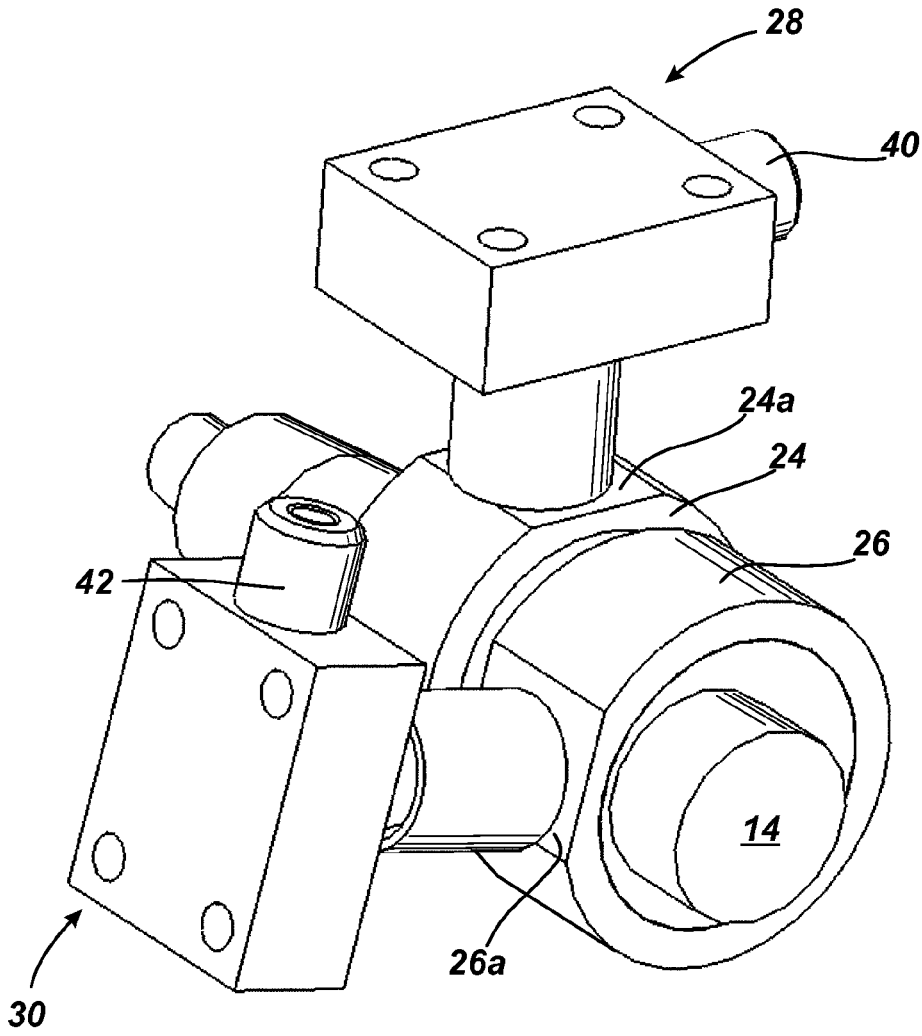
FIG. 3 is a perspective view of the fuel pump assembly in FIG. 2, but with a main pump housing removed to reveal the drive shaft and cam components of the assembly.
Figure 4:
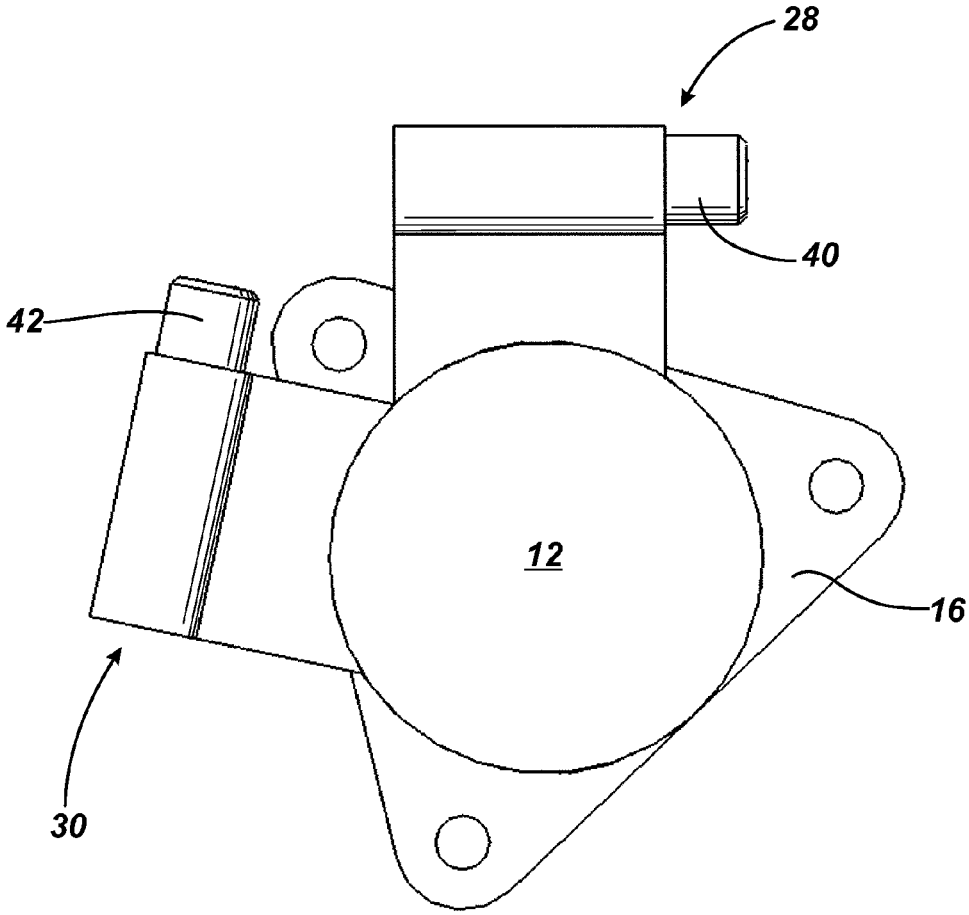
FIG. 4 is a view from the rear of the fuel pump assembly in FIGS. 1 and 2.
Figure 5:
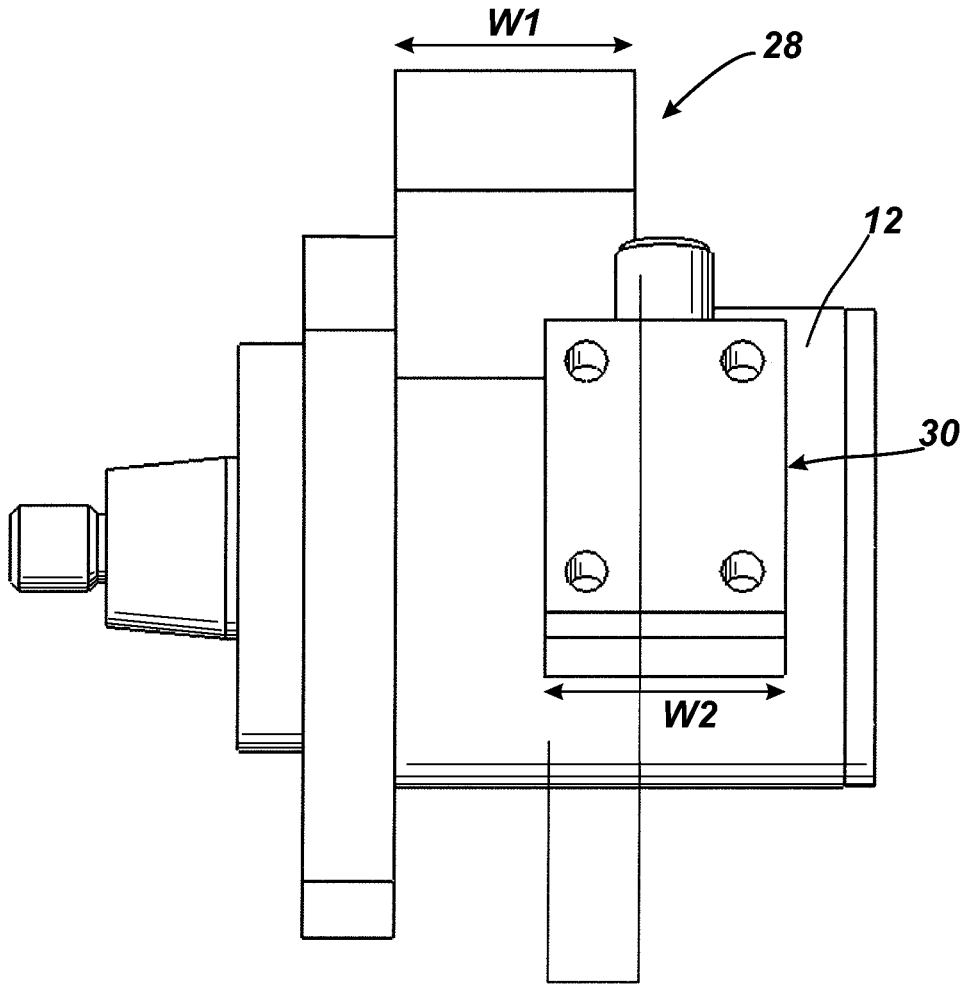
FIG. 5 is a view from the side of the fuel pump assembly in FIGS. 1 and 2.
Figure 6:
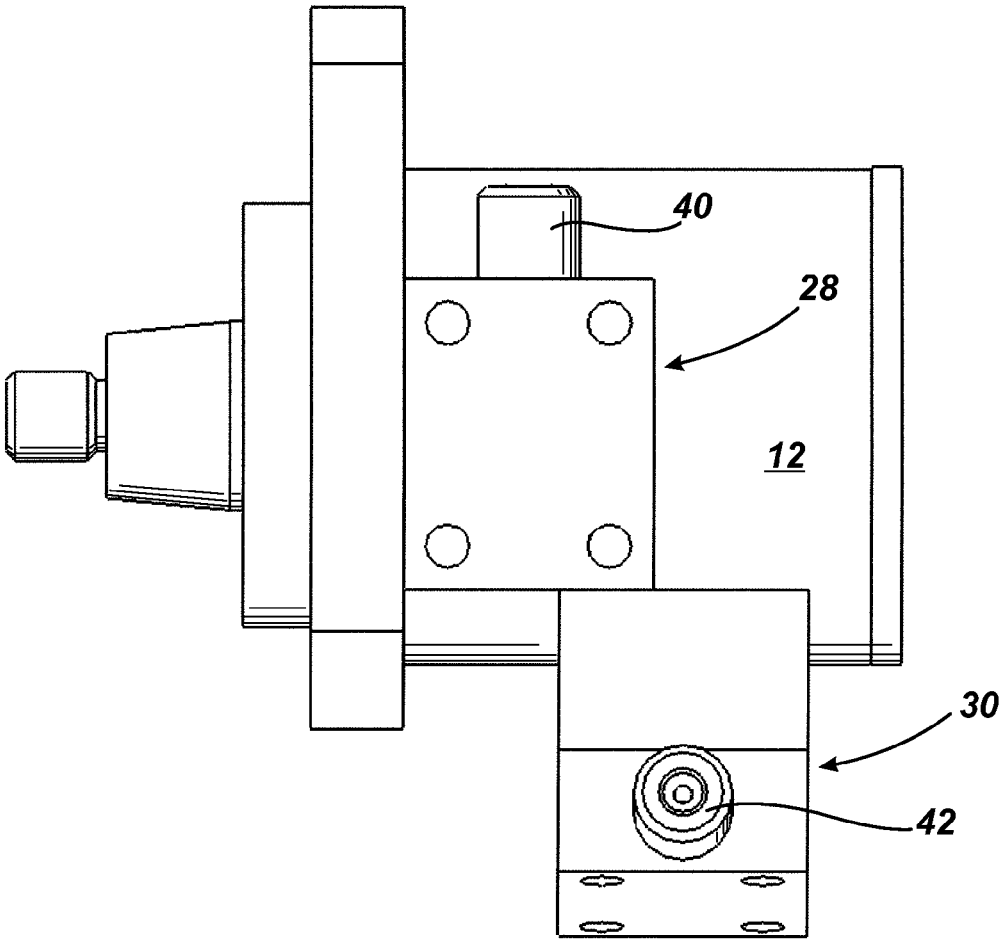
FIG. 6 is a top view of the fuel pump assembly in FIGS. 1 and 2.

Fuel that is pressurised within the pump chamber 38 during the pumping stroke is supplied through an outlet valve (not shown) provided within the pump head housing 28*a* to an outlet 40 of the pump head 28, as can be seen in FIGS. 2, 3 and 4. A similar outlet valve and corresponding outlet 42 is provided on the second pump head 30. The outlets 40, 42 from the first and second pump heads 28, 30 deliver pressurised fuel to a downstream common rail (not shown), or other accumulator volume, from where fuel is delivered to the fuel injection system of the engine.

As best illustrated in FIGS. 2, 3 and 4, it is a particular feature of the invention that the first and second pump heads 28, 30 are angularly offset relative to each other about the drive shaft 14. In particular, the angular spacing is sufficient that the maximum width of one pump head (identified in FIG. 5 as W1 and W2 for the first and second pump heads 28 and 30, respectively), in a direction parallel to the axis of the drive shaft 14, does not coincide with the maximum width of the other pump head. The pump heads 28, 30 may therefore be positioned axially along the drive shaft 14 with a degree of overlap, as identified in FIG. 2 by region R, between the pump heads 28, 30. This enables the overall length of the pump to be reduced compared with conventional in-line pump arrangements with plungers arranged side by side, in a line.

Figure 7:
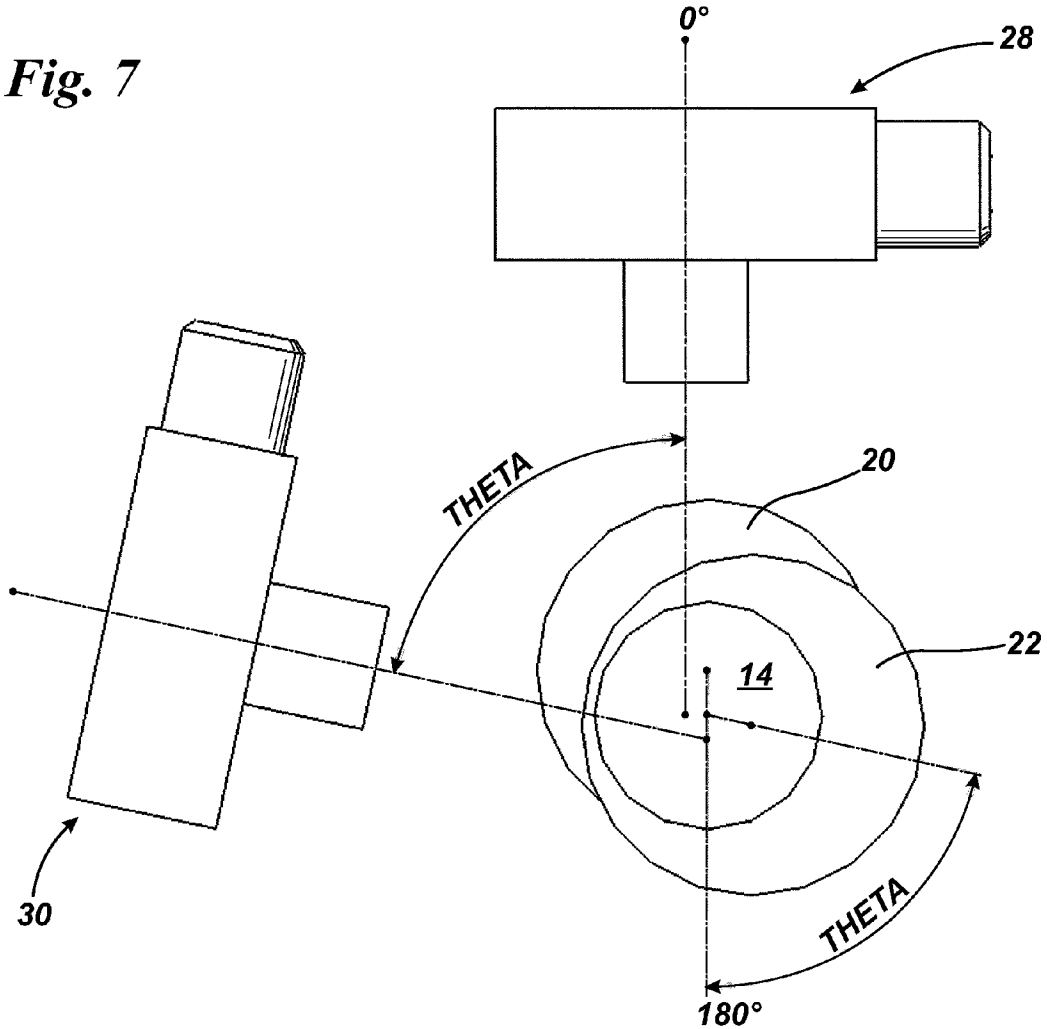
FIG. 7 is an exploded view of the cams and pump heads of the fuel pump assembly in FIGS. 1 and 2 to illustrate angular offsets.
Figure 8:
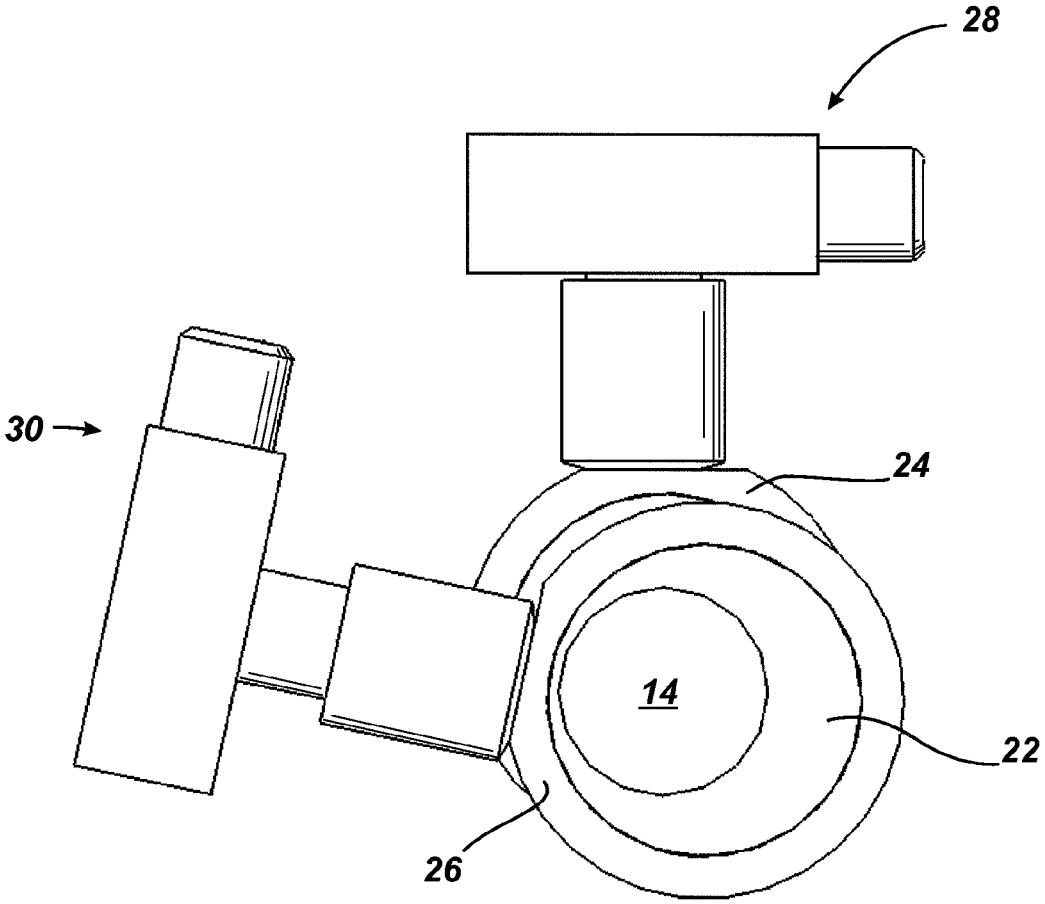
FIG. 8 is a view, similar to that shown in FIG. 7, with the riders assembled onto the drive shaft and the tappets also being visible.

Referring to FIGS. 7 and 8, the angular spacing between the first and second pump heads 28, 30, and hence between the plungers of the respective pump heads, is illustrated in more detail. In FIG. 8 in particular, it can be seen that the angular spacing of the pump heads 28, 30 is sufficient for there to be a degree of overlap between the widths of the pump head housings 28*a*, 30*a* along the direction of the drive shaft axis.

Since the cam 20, 22 for each plunger is machined individually, the relative angular spacing can be adjusted to maintain equal angular and temporal spacing of pumping events within each pump head, if desired. Typically, in a known in-line pump arrangement with two plungers side by side, that is to say parallel and adjacent one another, and in which each cam pumps once per revolution of the drive shaft, the two cams are identical in profile but are spaced angularly by 180° around the drive shaft so that the pumping events are 180° apart. This gives two evenly spaced pumping events per drive shaft revolution.

Referring to FIG. 7, in the first embodiment of the invention described above, the first cam 20 is shown oriented so that it is positioned at a reference position indicated by the line labelled "0°". The first pump head 28 is also oriented so that it is positioned at the reference position of 0°. The reference position for the second pump head 30 is also 0°, whereas the reference position for the second cam 22 is indicated by the line labelled 180° (i.e. 180° from the reference position of the first cam 20). It should be appreciated that the so-called 'reference positions' correspond to the positions of the respective cams and pump heads in the known in-line pump arrangement. In order to achieve evenly spaced pumping events, the second cam 22 is displaced angularly (by an angle theta) in the direction of rotation of the drive shaft 14, relative to its reference position at 180°, by the same angle (theta) as the plunger of the second pump head 30 is displaced, in the direction of rotation of the drive shaft 14, from the plunger 32 of the first pump head 28. From the foregoing description, it will be appreciated that the orientation of the second pump head 30 and its cam 22 in positions which are displaced angularly from their respective reference positions permits a degree of axial overlap between the first and second pump heads, therefore achieving a beneficial length reduction of the pump assembly as a whole compared to the known in-line pump arrangement, whilst maintaining regular timing of pumping events.

In an alternative arrangement to that illustrated in FIG. 7, the angular spacing between the plungers of each pump head 28, 30 could be different to the angular offset between the cams 20, 22 to produce uneven pumping intervals, depending on the particular application.

In yet another embodiment, not shown, the first pump head is at a pump head angular reference position, a corresponding first one of the cams is at a cam angular reference position, the second pump head is spaced angularly from the pump head angular reference position by an angular offset amount and a corresponding second one of the cams is spaced by the angular offset amount from a position substantially 180° from the pump head angular reference position.

The present invention is not limited to a pump assembly having only first and second pump heads, and hence first and second plungers, but additional pump heads and plungers may be provided along the drive shaft axis 14, depending on pump requirements. The angular offset between each pair of adjacent pump heads along the drive shaft 14 could be in the same angular direction around the drive shaft as the offset between the preceding pump head pair, or could be in the opposite direction. For several pump heads, where the angular offset alternates in direction between adjacent pump head pairs, the arrangement of the pump heads resembles that of the cylinders in a "vee" engine and hence provides a compactness benefit.

In embodiments in which more than two pump heads are provided on the drive shaft 14, cam riders cannot be used conveniently as cam followers since each has to be assembled over its corresponding cam by axial sliding from the direction of the nearby end of the drive shaft and the cams are mutually obstructive of further sliding. To overcome this difficulty, successively larger diameter cams could be used along the drive shaft, although this may be less practical in a construction sense. Alternatively, it may be preferable to use rollers as cam followers. Should a roller arrangement be used as the cam follower, this provides the option for the cams to have more than one lobe (i.e. more than one pumping event per revolution of the drive shaft).

The pump construction illustrated in FIGS. 1 to 6 shows each pump head 28, 30 with its own outlet, 40, 42, respectively, for high pressure fuel, with each of the outlets 40, 42 delivering fuel through a respective high pressure supply line (not shown) to the common rail. However, in another embodiment (not shown) the pump heads need not be provided with their own outlets but the high pressure flow may be routed from the pump chamber in each pump head into the main pump housing, and from there to a single outlet for delivery to the common rail. Although the latter option avoids the need for the outlet 40, 42 on each pump head, it places additional requirements on the main pump housing 12 which must then be able to sustain the high pressure of fuel supplied to the common rail. Although the overall envelope of the pump assembly is simplified, this poses a material cost disadvantage on the main pump housing 12.

Although particular embodiments of the invention have been disclosed herein in detail, this has been done by way of example and for the purposes of illustration only. The aforementioned embodiments are not intended to be limiting with respect to the scope of the appended claims, which follow. It is proposed by the inventors that various substitutions, alterations, and modifications may be made to the invention without departing from the spirit and scope of the invention as defined by the claims.

The invention claimed is:

1. A fuel pump assembly for a fuel injection system, the fuel pump assembly comprising; a drive shaft, at least two pump heads each of which is axially displaced along the drive shaft, each pump head having a respective plunger for pressurising fuel within a respective pump chamber, and at least two cams provided on the drive shaft, each of which is associated with a respective one of the pump heads, wherein adjacent pump heads are offset angularly from one another by an amount sufficient to allow a region of overlap, in an axial direction along the drive shaft, between said adjacent pump heads, and wherein none of the plungers lie in the same axial plane as any other of the plungers.

2. The fuel pump assembly as claimed in claim 1, wherein the angular offset between the cams associated with adjacent ones of the pump heads is substantially the same and in the same angular direction as the angular offset between the adjacent ones of the pump heads plus 180°, so as to enable evenly spaced pumping events within the respective pump chambers.

3. The fuel pump assembly as claimed in claim 1, wherein the angular offset between the cams associated with adjacent ones of the pump heads is different from the angular offset between the adjacent ones of the pump heads plus 180°, so as to enable unevenly spaced pumping events within the respective pump chambers.

4. The fuel pump assembly as claimed in claim 2, comprising a first pump head and a second pump head, wherein the first pump head is at a pump head angular reference position, a corresponding first one of the cams is at a cam angular reference position, the second pump head is spaced angularly from the pump head angular reference position by an angular offset amount and a corresponding second one of the cams is spaced by the angular offset amount from a position substantially 180° from the cam angular reference position.

5. The fuel pump assembly as claimed in claim 1, comprising at least three pump heads, wherein the direction of the angular offset between a pair of adjacent pump heads alternates between adjacent pump head pairs.

6. The fuel pump assembly as claimed in claim 5, wherein the angular offset between the cams associated with a pair of adjacent pump heads is substantially the same and in the same angular direction as the angular offset between the adjacent pair of pump heads plus 180°.

7. The fuel pump assembly as claimed in claim 1, comprising at least three pump heads, wherein the angular offset between a pair of adjacent pump heads is substantially the same and in the same angular direction as the angular offset between the preceding adjacent pump head pair along the drive shaft.

8. The fuel pump assembly as claimed in claim 7, wherein the angular offset between the cams associated with a pair of adjacent pump heads is substantially the same and in the same angular direction as the angular offset between the adjacent pair of pump heads plus 180°.

9. The fuel pump assembly as claimed in claim 1, comprising at least three pump heads, wherein the angular offset between a first pair of adjacent pump heads is different to the angular offset between a second pair of adjacent pump heads along the drive shaft.

10. The fuel pump assembly as claimed in claim 9, wherein the angular offset between the cams associated with a pair of adjacent pump heads is substantially the same and in the same angular direction as the angular offset between the adjacent pair of pump heads plus 180°.

11. The fuel pump assembly as claimed in claim 1, wherein each of the pump heads has an associated cam follower which cooperates with the respective cam to impart drive to the plunger as the drive shaft is driven to rotate, and wherein the cam followers are rollers.

12. The fuel pump assembly as claimed in claim 1, wherein each of the pump heads has an associated cam follower which cooperates with the respective cam to impart drive to the plunger as the drive shaft is driven to rotate.

13. The fuel pump assembly as claimed in claim 12, wherein each of the cam followers is a cam rider of generally tubular form.

14. The fuel pump assembly as claimed in claim 1, wherein each of the pump heads has an associated outlet for providing fuel that is pressurised within the associated pump chamber to a fuel accumulator volume.

15. The fuel pump assembly as claimed in claim 1, further comprising a main pump housing onto which the pump heads are mounted, wherein each of the pump heads delivers fuel that is pressurised within the associated pump chamber to the main pump housing which, in turn, delivers fuel to a high pressure outlet to a downstream fuel accumulator volume.

16. A fuel pump assembly for a fuel injection system, the fuel pump assembly comprising; a drive shaft, at least two pump heads each of which is axially displaced along the drive shaft, each pump head having a respective plunger for pressurising fuel within a respective pump chamber, wherein adjacent pump heads are axially displaced and offset angularly from one another by an amount sufficient to allow a region of overlap, in an axial direction along the drive shaft, between said adjacent pump heads, the region of overlap being less than the maximum width of the adjacent pump heads, and wherein none of the plungers lie in the same axial plane as any other of the plungers, and at least two cams provided on the drive shaft, each of which is associated with a respective one of the pump heads, and wherein the angular offset between the respective cams is selected so as to achieve evenly spaced pumping events.

17. The fuel pump assembly as claimed in claim 16, comprising at least three pump heads, wherein the direction of the angular offset between a pair of adjacent pump heads alternates between adjacent pump head pairs.

18. The fuel pump assembly as claimed in claim 16, comprising at least three pump heads, wherein the angular offset between a pair of adjacent pump heads is substantially the same and in the same angular direction as the angular offset between the preceding adjacent pump head pair along the drive shaft.

19. The fuel pump assembly as claimed in claim 16, comprising at least three pump heads, wherein the angular offset between a first pair of adjacent pump heads is different to the angular offset between a second pair of adjacent pump heads along the drive shaft.

* * * * *